US011963650B2

(12) United States Patent
Garcia et al.

(10) Patent No.: US 11,963,650 B2
(45) **Date of Patent: *Apr. 23, 2024**

(54) SLIDING-PIVOTING MECHANISM FOR A RACK OF A PIECE OF FURNITURE OR OF A DOMESTIC APPLIANCE, AND PIECE OF FURNITURE OR DOMESTIC APPLIANCE

(71) Applicant: PAUL HETTICH GMBH & CO. KG, Kirchlengern (DE)

(72) Inventors: Oscar Garcia, San Sebastian (ES); Iker Lopetegi, Zarautz (ES); Ander Martinez, Donostia (ES); Patrick Bon, Horgen (CH); Thomas Wieder, Stetten (FR)

(73) Assignee: Paul Hettich GmbH & Co. KG, Kirchlengern (DE)

( * ) Notice: Subject to any disclaimer, the term of this patent is extended or adjusted under 35 U.S.C. 154(b) by 310 days.

This patent is subject to a terminal disclaimer.

(21) Appl. No.: 17/441,337

(22) PCT Filed: Mar. 4, 2020

(86) PCT No.: PCT/EP2020/055683
§ 371 (c)(1),
(2) Date: Sep. 21, 2021

(87) PCT Pub. No.: WO2020/193093
PCT Pub. Date: Oct. 1, 2020

(65) Prior Publication Data

US 2022/0160205 A1 May 26, 2022

(30) Foreign Application Priority Data

Mar. 22, 2019 (DE) ..... 10 2019 107 385.5

(51) Int. Cl.
*A47L 15/50* (2006.01)
*A47B 96/07* (2006.01)
*A47B 88/90* (2017.01)

(52) U.S. Cl.
CPC ..... *A47L 15/506* (2013.01); *A47B 96/07* (2013.01); *A47L 15/507* (2013.01); *A47B 2088/901* (2017.01)

(58) Field of Classification Search
CPC ..... A47L 15/506; A47L 15/507; A47B 96/07; A47B 2088/901
(Continued)

(56) References Cited

U.S. PATENT DOCUMENTS 9,420,882 B2 * 8/2016 Garcia ..... A47B 46/005
9,549,660 B2 * 1/2017 Park ..... A47L 15/506
(Continued)

FOREIGN PATENT DOCUMENTS

| | | | |
|---|---|---|---|
| CN | 109431426 | A | 3/2019 |
| DE | 102018111657 | A1 | 2/2019 |
| EP | 2890271 | B1 | 10/2016 |
| WO | 2019030067 | A1 | 2/2019 |

OTHER PUBLICATIONS

International Search Report dated Apr. 29, 2020 in related/corresponding International Application No. PCT/EP2020/055683.
(Continued)

*Primary Examiner* — Daniel J Troy
*Assistant Examiner* — Timothy M Ayres
(74) *Attorney, Agent, or Firm* — PATENT PORTFOLIO BUILDERS PLLC

(57) ABSTRACT

A sliding-pivoting mechanism for a rack includes two pivot arms pivotably secured to the carcass, arranged parallel to one another, and forming a parallel guide for a pull-out guide having a guide rail and a running rail to which the rack is
(Continued)

fastened. A locking mechanism is arranged on the guide rail and on one of the pivot arms to prevent a simultaneous pivoting and sliding movement. The locking mechanism has a locking pin arranged movably on one of the pivot arms and a locking plate mounted in a positionally fixed manner with respect to the guide rail and which interacts with the locking pin to block a pivoting movement of the pivot arms if the rack is lifted into an upper loading and unloading position. An unlocking device, coupled to the locking mechanism, has an actuating element and an unlocking element to move the locking pin from a blocking position into a release position.

12 Claims, 11 Drawing Sheets

(58) Field of Classification Search
USPC ..... 312/266
See application file for complete search history.

(56) References Cited

U.S. PATENT DOCUMENTS

| | | | | |
|---|---|---|---|---|
| 9,596,975 | B2 * | 3/2017 | Bhajak | A47L 15/4246 |
| 9,854,905 | B2 * | 1/2018 | Azkue | A47B 46/005 |
| 9,993,072 | B2 * | 6/2018 | Azkue | F24C 15/168 |
| 10,051,963 | B2 * | 8/2018 | Azkue | A47B 88/497 |
| 10,729,306 | B2 * | 8/2020 | Roos | A47L 15/50 |
| 11,445,823 | B2 * | 9/2022 | Bextermöller | A47B 88/437 |
| 2006/0066189 | A1 * | 3/2006 | Bond | A47L 15/507 312/319.1 |
| 2022/0160206 | A1 * | 5/2022 | Garcia | A47B 96/07 |

OTHER PUBLICATIONS

Search Report dated Jan. 10, 2020 in related/corresponding DE Application No. 10 2019 107 385.5.

Written Opinion dated Apr. 29, 2020 in related/corresponding International Application No. PCT/EP2020/055683.

* cited by examiner

SLIDING-PIVOTING MECHANISM FOR A RACK OF A PIECE OF FURNITURE OR OF A DOMESTIC APPLIANCE, AND PIECE OF FURNITURE OR DOMESTIC APPLIANCE

BACKGROUND AND SUMMARY OF THE INVENTION

Exemplary embodiments of the present invention relate to a sliding-pivoting mechanism for a rack of a piece of furniture or domestic appliance for pulling out and lifting the rack from a carcass of the piece of furniture or domestic appliance, as well as to a piece of furniture or domestic appliance.

A generic sliding-pivoting mechanism for a rack of a piece of furniture or domestic appliance is known, for example, from EP 2 890 271 B1.

Such sliding-pivoting mechanisms can be used, for example, in furniture or domestic appliances such as dishwashers, refrigerators, freezers, or cooking appliances in order to be able to pull a rack, for example in the form of a drawer, a dish basket, container, or cooking product carrier, out of the interior of the furniture or domestic appliance and lift it upwards. In the lifted position of the rack, loading or unloading of the rack is convenient for the user.

In practice, such sliding-pivoting mechanisms have proven their worth. In particular, the locking of this sliding-pivoting mechanism, which prevents simultaneous sliding movement of the running rail and pivoting movement of the pivot arms, ensures reliable operation of the sliding-pivoting mechanism as well as a secured lifted position of the rack in which the user can conveniently load or unload it.

A disadvantage of the sliding-pivoting mechanism described in the above-mentioned publication is that a locking pin of a locking mechanism, with which the rack is secured in the upper loading and unloading position, is briefly subjected to a large part of the weight of the rack together with the load for unlocking, since the locking pin must be lifted out of its locking position, a vertical locking groove, for unlocking.

Exemplary embodiments of the present invention are directed to a sliding-pivoting mechanism for a rack of a piece of furniture or domestic appliance, with which the unlocking of the rack from the upper loading and unloading position can be performed even more easily and, in particular, the locking pin of the locking mechanism is relieved.

The sliding-pivoting mechanism according to the invention has at least two pivot arms, which can be pivotally fixed to the carcass and are arranged parallel to one another, forming a parallel guide for a pull-out guide.

The pull-out guide has at least one guide rail and a running rail, which can be moved relative to the guide rail and to which the rack is attached.

The sliding-pivoting mechanism further has a locking mechanism arranged on the guide rail and on one of the pivot arms to prevent simultaneous pivoting and sliding movement.

The locking mechanism has a locking pin movably arranged on one of the pivot arms and a locking plate mounted in a positionally fixed manner with respect to the guide rail and with which the locking pin interacts in such a way that a pivoting movement of the pivot arms is blocked when the rack is lifted to an upper loading and unloading position.

The sliding-pivoting mechanism further comprises an unlocking device coupled to the locking mechanism and having an actuating element and an unlocking element for moving the locking pin from a blocking position to a release position.

The sliding-pivoting mechanism further comprises a support device having a guide element arranged on one of the pivot arms and a support element arranged on the rack, which is movable relative to the guide element and can be supported on the guide element in a support position.

With such a sliding-pivoting mechanism, it is possible in a simple manner to release the locking of the rack from the upper loading and unloading position by actuating the actuating element of the unlocking device.

The support device of the sliding-pivoting mechanism relieves the load on the locking pin in such a way that the locking pin can be lifted into its unlocked position during the unlocking process without having to bear the load of the rack at the same time.

According to an advantageous embodiment variant of the invention, the actuating element is designed as a handle that can be tilted about a horizontal pivot axis and is coupled to the unlocking element via a transmission lever.

On the one hand, such a tiltable handle makes it easy to pull out and push in the rack and, at the same time, allows the unlocking element to be pulled out and actuated almost simultaneously.

According to an advantageous embodiment, the unlocking element is designed as a wedge arranged on the transmission lever, with which the locking pin can be pressed out of a locking groove of the locking plate along an inclined edge of the wedge.

The wedge-shaped design of the unlocking element allows a simple linear, in particular horizontal, movement of the transmission lever to which the wedge is coupled and thus a simple conversion of the movement of the transmission lever into a lifting of the locking pin required perpendicularly thereto.

According to a further advantageous embodiment variant, the guide element is fixed to the second pivot lever and, when a pivoting movement is performed, the pivot lever can be guided along a guide groove of a guide adapter attached to the rack.

The guide element thus fulfills two tasks, namely on the one hand the guided movement of the rack when it is lifted and lowered and on the other hand supporting the load of the rack and thus relieving the locking pin when the locking mechanism is unlocked.

According to a particular embodiment variant, the support element is designed as a section of the unlocking device.

In particular, the support element is formed on an arm aligned at an angle to the transmission lever, wherein, when the actuating element is moved from a first switching position to a second switching position of the actuating element, the support element projects into a guide groove of the guide adapter in such a way that it can be pushed onto the guide element.

When the support element is pushed on, the rack is lifted slightly, thus facilitating the subsequent release of the locking pin from its locking position in the locking groove of the locking plate.

According to an alternative embodiment variant, the support element is formed as a section of the guide adapter.

The support element is formed in particular within the guide groove, wherein the support element can be pushed onto the guide element when the rack is moved from the upper loading and unloading position in the pull-out direction.

This variant also permits simple support of the rack on the support element, in this case by moving the rack slightly in the pull-out direction of the rack.

To prevent unintentional unlocking to a substantial extent, the unlocking device is spring-loaded and held in the basic position.

In particular, a spring element held on the transmission lever is held on the guide adapter, wherein the spring force of the spring element counteracts a movement of the transmission lever out of the first switching position.

The arrangement of such a spring element between the transmission lever and the guide adapter represents an extremely simple and cost-effective means of securing the unlocking device in the first switching position.

According to a further embodiment variant, in order to limit the tilting movement of the actuating element, the transmission lever, which is aligned parallel to the pivot axis of the actuating element, is held by at least one clip fastened to a web of the rack.

The clip enables a guided pivoting movement of the transmission lever about an axis parallel to the pivot axis of the actuating element.

The piece of furniture or domestic appliance according to the invention, comprising a carcass and at least one rack guided in the carcass by a sliding-pivoting mechanism, is characterized by a sliding-pivoting mechanism as described above.

In the case of a domestic appliance designed as a dishwasher, the rack is preferably designed as a dish rack.

BRIEF DESCRIPTION OF THE DRAWING FIGURES

In the following, preferred embodiment variants of the invention are explained in more detail with reference to the accompanying drawings, wherein:

FIG. 1 shows an isometric view of a dishwashing machine having a retracted upper dish rack and a lower dish rack guided by a sliding-pivoting mechanism that is in a lifted and extended position, FIG. 2 shows a perspective view of the lower dish rack with running rail attached thereto, unlocking device and a first variant of a guide adapter, FIG. 3 shows a partial exploded view of the unlocking device and guide adapter according to FIG. 2, FIG. 4 shows a side view of the lower dish rack with sliding-pivoting mechanism arranged thereon in an upper loading and unloading position in the position secured by the locking pin, FIG. 5 shows an enlargement of the section shown in FIG. 4 with V to show the locking pin and guide element in more detail, FIGS. 6 and 7 show representations corresponding to FIGS. 4 and 5, in which the support element is supported on the guide element and the locking pin is still in the blocking position, FIGS. 8 and 9 show representations corresponding to FIGS. 4 and 5, in which the locking pin is lifted out of its blocking position and the support element releases the guide element, FIG. 10 shows an alternative embodiment variant, corresponding to FIG. 1, of a sliding-pivoting mechanism according to the invention having an alternatively designed unlocking device and guide adapter, FIG. 11 shows a representation of the rack corresponding to FIG. 2 having an alternative variant of the unlocking device and the guide adapter arranged thereon, FIG. 12 shows a partial exploded view of the guide adapter and unlocking device shown in FIG. 11, FIG. 13 shows a side view of the sliding-pivoting mechanism, rack, unlocking device and guide adapter in the upper loading and unloading position of the rack shown in FIG. 10 in the position locked by the locking pin, FIG. 14 shows a detailed view of the section labeled XIV in FIG. 13, FIGS. 15 and 16 show representations corresponding to FIGS. 13 and 14 with the rack pulled forward slightly in the pull-out direction, in which the support element of the guide adapter is supported on the guide element, FIGS. 17 and 18 show representations corresponding to FIGS. 15 and 16 after pivoting the actuating element, in which the locking pin is lifted out of the locking groove and the support element of the guide adapter still rests on the guide element, and FIGS. 19 and 20 show illustrations corresponding to FIGS. 17 and 18, in which the rack is shifted further in the pull-out direction and the support element thus releases the guide element.

DETAILED DESCRIPTION

In the following figure description, terms such as top, bottom, left, right, front, rear, etc. refer exclusively to the exemplary representation and position of the sliding-pivoting mechanism, the rack, the pivot arms, the locking pin, the locking plate, the unlocking element, the guide element, the support element, and the like selected in the respective figures. These terms are not to be understood restrictively, i.e., different working positions or the mirror-symmetrical design or the like can change these references.

Figure 1:
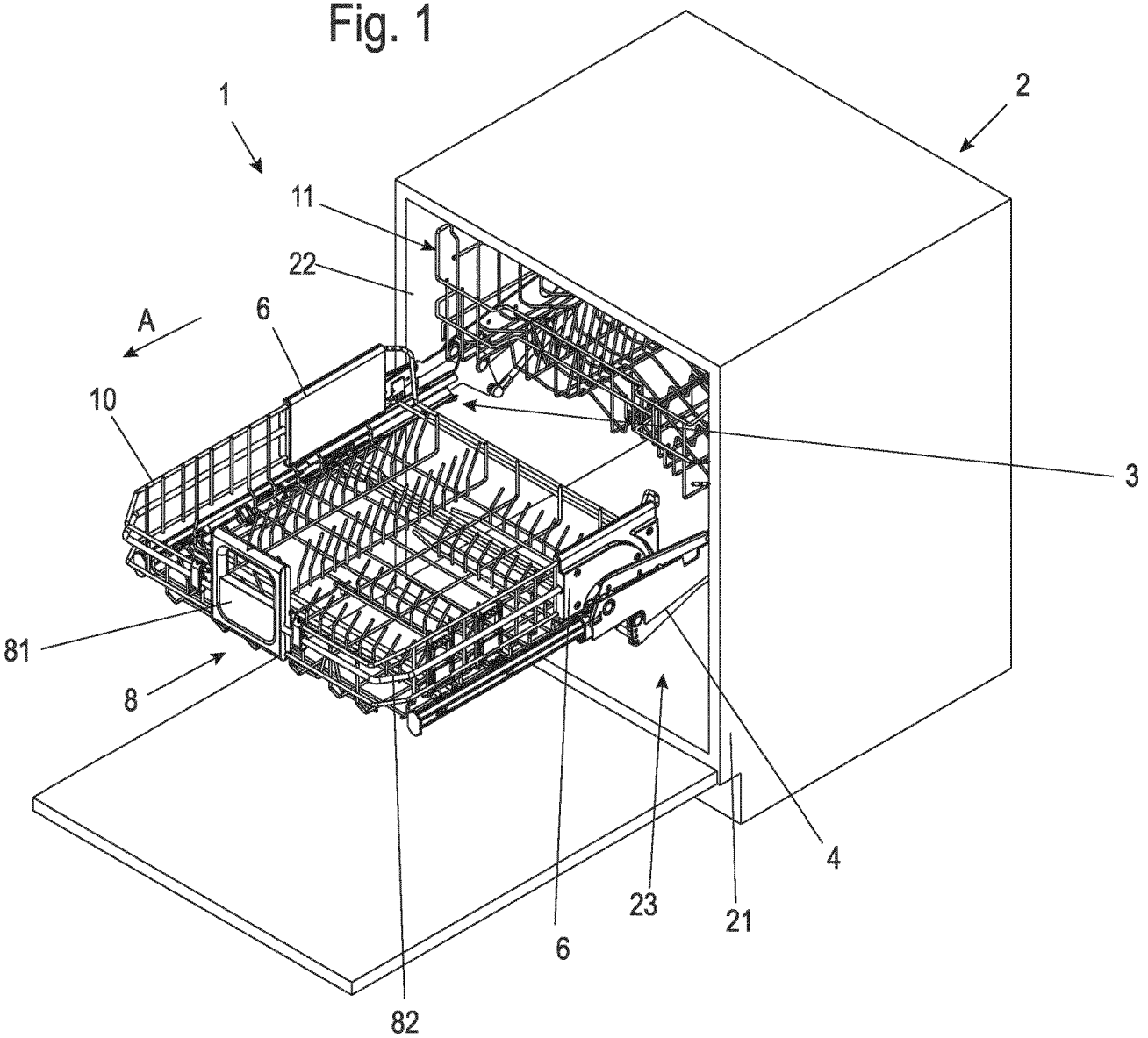
FIGS. 1 to 9 show a first embodiment variant of a sliding-pivoting mechanism according to the invention.

Common to both embodiments is their use on a rack 10 of a piece of furniture or domestic appliance 1 for pulling out and lifting a lower rack 10 from a carcass 2 of the piece of furniture or domestic appliance 1.

In both embodiment variants, the sliding-pivoting mechanism has at least two pivot arms 4, 5 that can be fixed to the carcass 2 in a pivoting manner and are arranged parallel to each other, forming a parallel guide for a pull-out guide 3.

Figure 4:
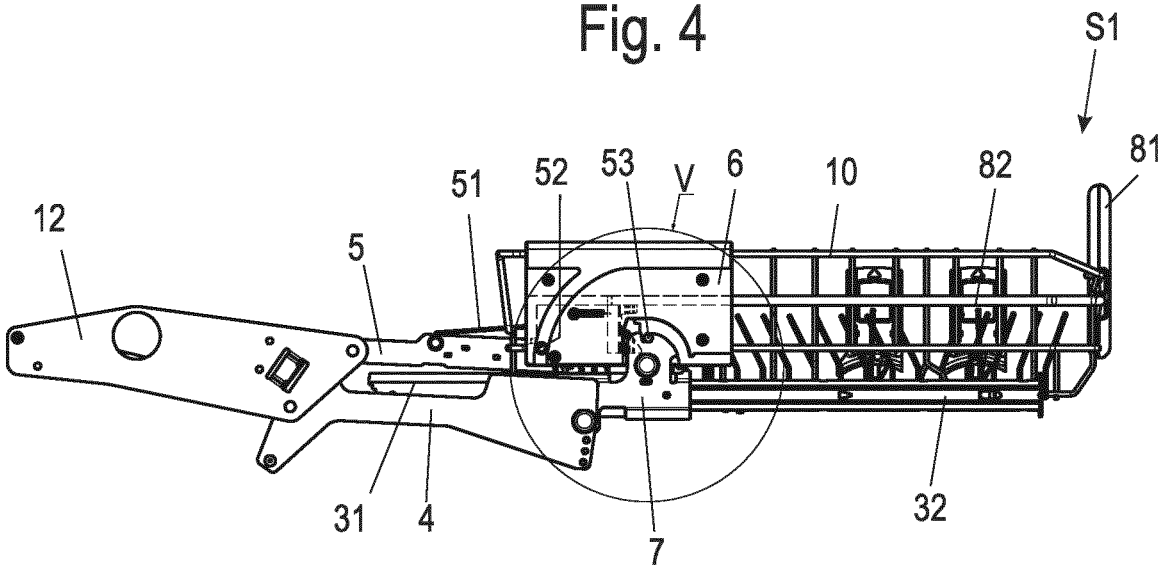
Figure 13:
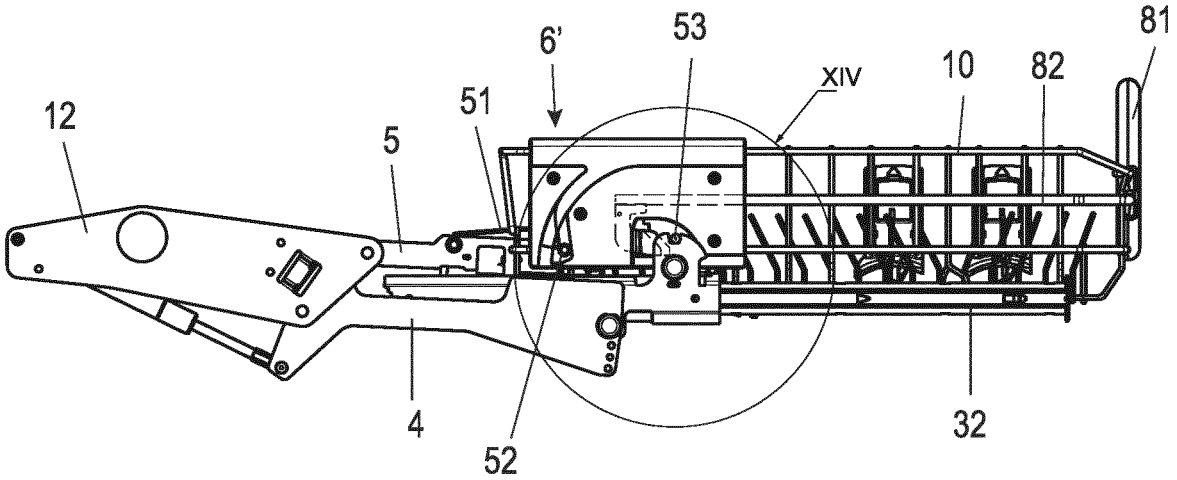

The pivot arms 4, 5 are preferably fixed in place by means of a side wall mounting 12, as shown for example in FIG. 4 and FIG. 13. Each of the pivot arms 4, 5 is pivotably connected to the side wall mounting 12 by a pivot joint.

It is also conceivable to fix the pivot arms 4, 5 directly to a side wall 21, 22 of the carcass 2 of the furniture or domestic appliance 1.

The pull-out guide 3 has at least one guide rail 31 and a running rail 32 that can be moved relative to the guide rail 31. The rack 10 is attached to the guide rail 32.

It is also conceivable to arrange a center rail between the guide rail 31 and the running rail 32, which can be moved relative to the guide rail 31 and the running rail 32 and thus ensures an over-extension of the pull-out guide 3.

With the aid of the pull-out guide 3 and the pivot arms 4, 5, a lifting or lowering movement of the rack from a lower position to an upper loading and unloading position is possible in a manner known per se, as explained for example in the above-mentioned EP 2 890 271 B1.

The pull-out guide 3 allows the rack to be pulled out of or pushed into the interior 23 of the carcass 2. For a description of the movement sequence, reference is expressly made to EP 2 890 271 B1, the description of which is expressly referred to here.

To prevent simultaneous pivoting and sliding movement of the sliding-pivoting mechanism, the sliding-pivoting mechanism has a locking mechanism arranged on the guide rail 31 and, in the present case, on the first pivot arm 4. A partial arrangement of the locking mechanism on the second pivot arm 5 is also conceivable.

As shown in FIGS. 4 to 9 and 13 to 20, this locking mechanism comprises a locking pin 53 arranged on the pivot arm 5, in this case on a web 51 pivotally held on the pivot arm 5, and a locking plate 7 having a locking groove 71 extending vertically from an upper edge into the locking plate 7, in which the locking pin 53 can be locked in the upper loading and unloading position, as shown for example in FIGS. 4 and 13.

The locking plate 7 is mounted in a positionally fixed manner on the guide rail 31. Furthermore, the ends of the pivot arms 4, 5 are held at respective pivot joints on this locking plate 7.

For unlocking the locking pin 53 from this locking groove 71 in the locking plate 7, the sliding-pivoting mechanism comprises an unlocking device 8 coupled to the locking mechanism, having an actuating element 81 and an unlocking element 83, with which the locking pin 53 can be moved from the locking position described above into a release position.

The sliding-pivoting mechanism further comprises a support device having a guide element 52 arranged on one of the pivot arms 4, 5 and a support element 65', 85 arranged on the rack 10 and movable relative to the guide element 52 and supportable in a support position on the guide element 52.

A first embodiment variant of such an unlocking device 8 and a support device cooperating with it is described below with reference to FIGS. 1 to 9.

An alternative embodiment variant of such an unlocking device 8 and a support device is described below with reference to FIGS. 10 to 20.

Figure 3:
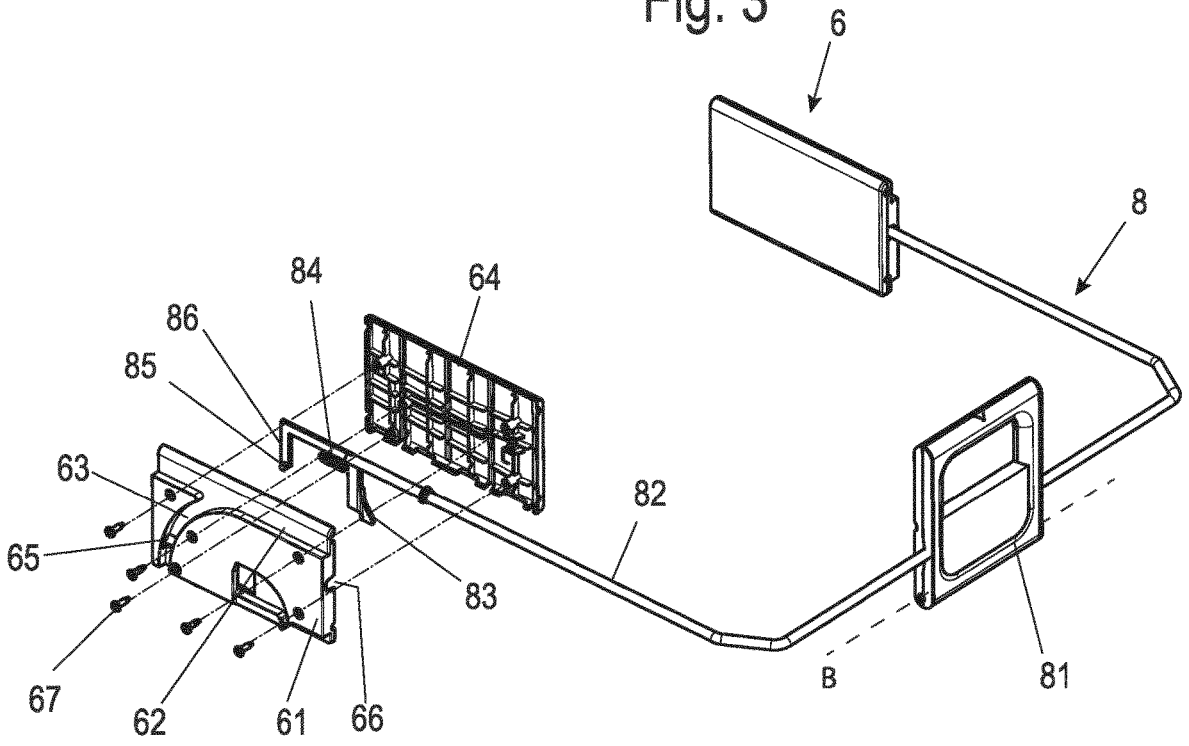
Figure 12:
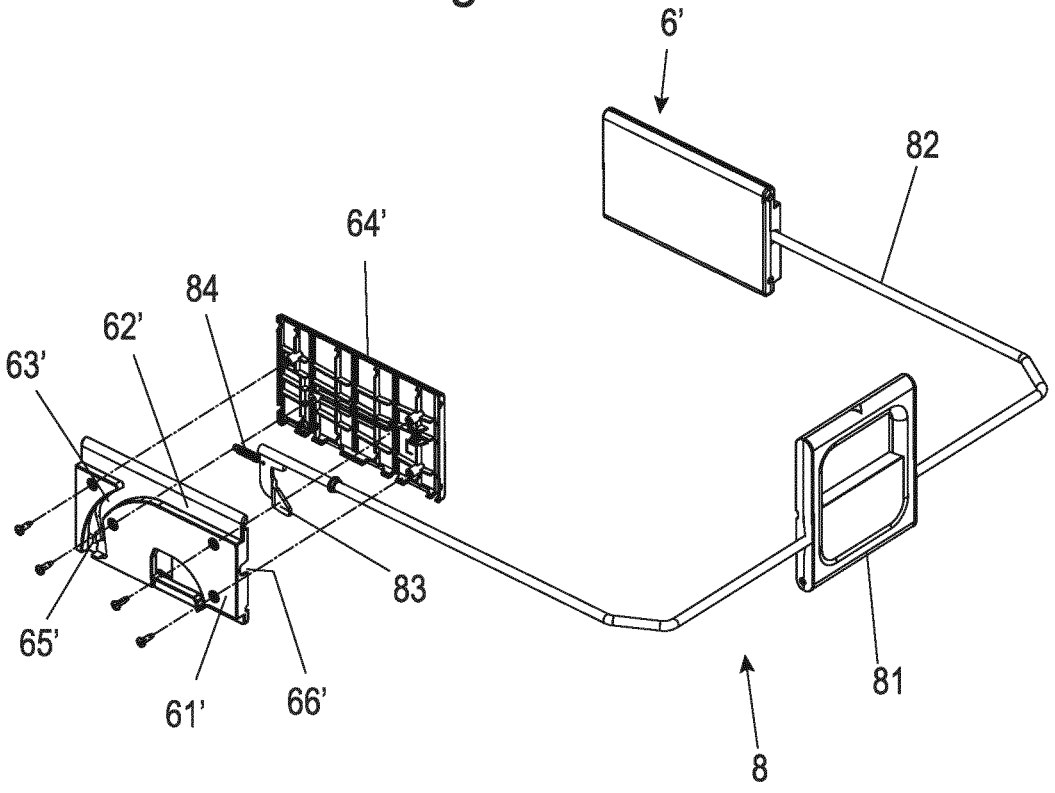

As shown in FIGS. 3 and 12, both variants of unlocking devices 8 have an actuating element 81 preferably designed as a handle.

Transmission levers 82 are provided on both sides of the actuating element 81 parallel to the web of the actuating element 81, which can be grasped by the hand of a user.

The transmission levers 82 are fixedly connected to the actuating element 81 and extend from side edges of the actuating element 81 projecting along a front side of the rack 10.

The transmission levers 82 are guided laterally around the side surfaces of the rack 10 via angle pieces and end in respective guide adapters 6, 6' arranged on both sides of the rack 10. In the exemplary embodiments shown here, the transmission levers 82 are guided in corresponding receiving grooves 66, 66' in the guide adapters 6, 6'.

Figure 8:
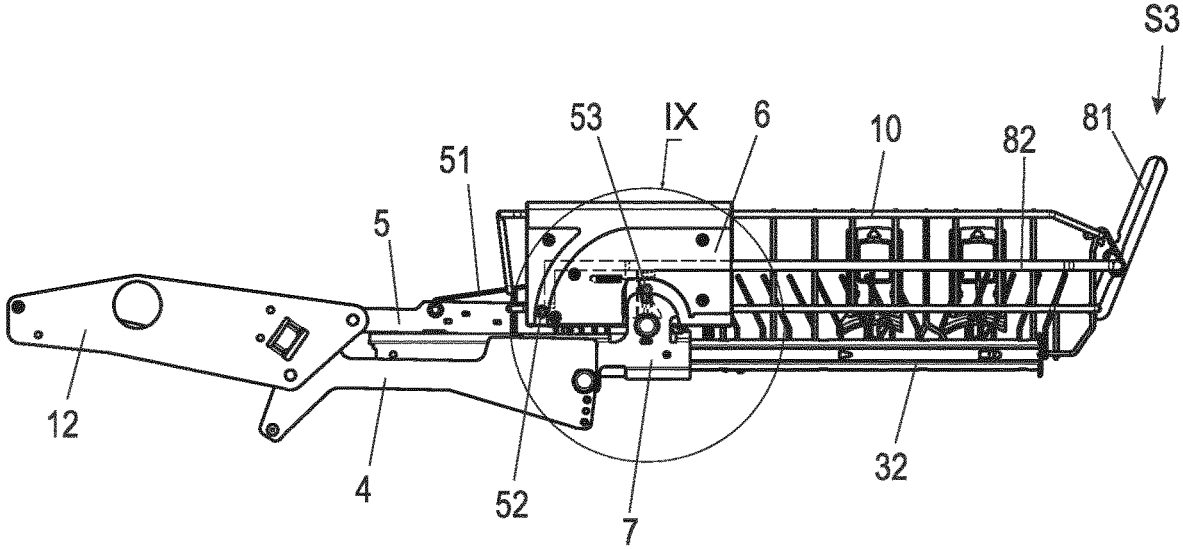
Figure 17:
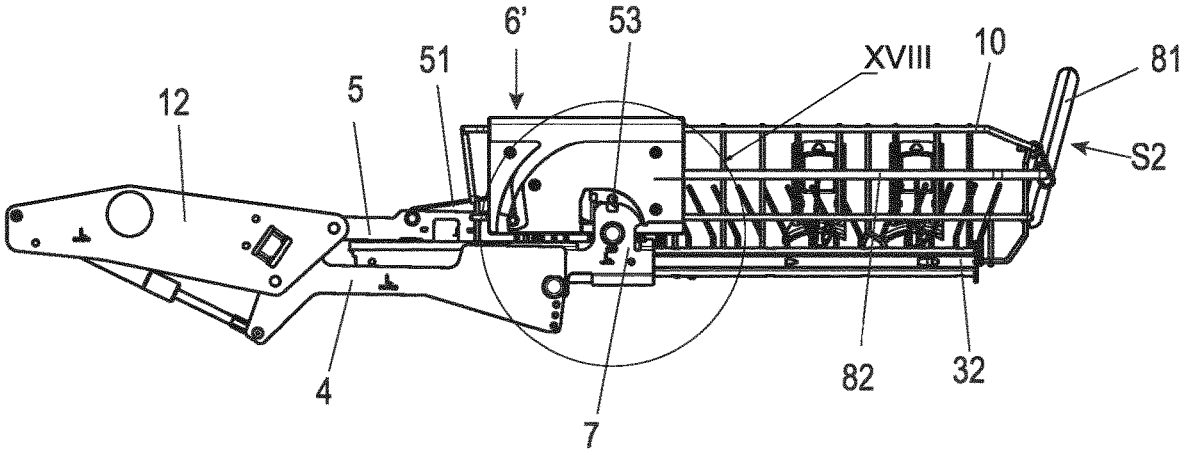
Figure 18:
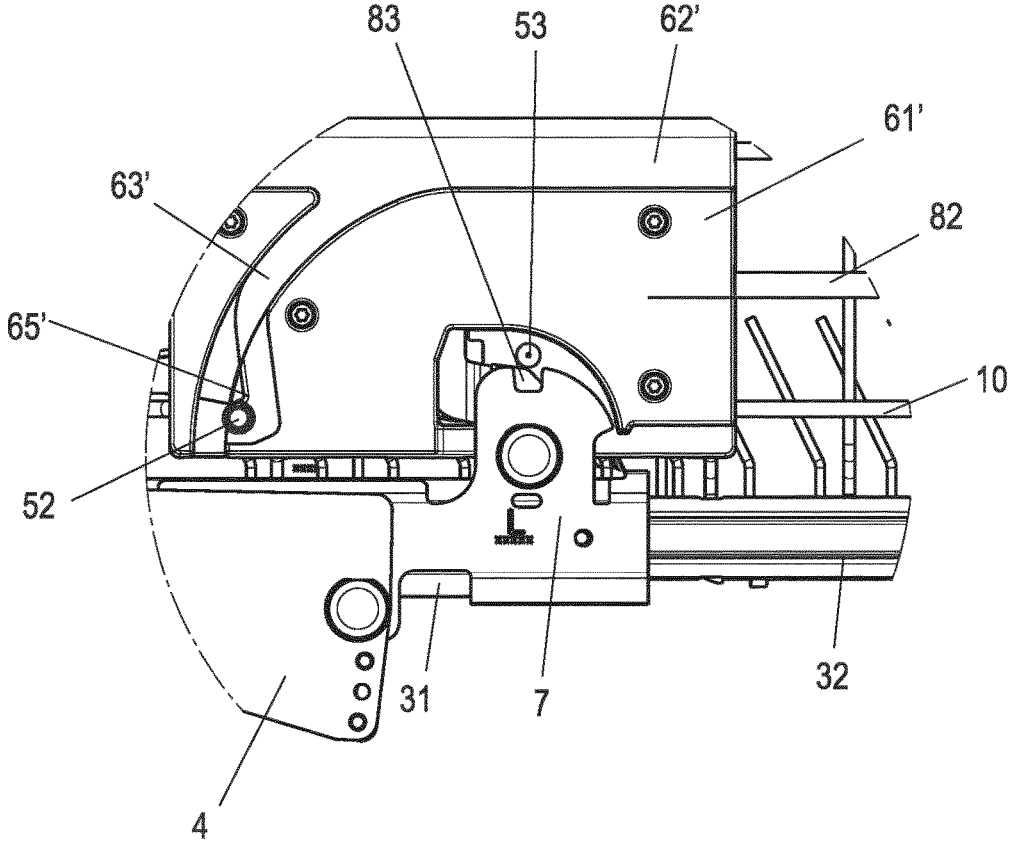

The actuating element 81, which is designed as a handle, has at its lower end a receptacle for a pivot axis B, about which the actuating element 81 can be pivoted, as shown for example in FIGS. 8 and 17, from a first switching position S1 or basic position, which is vertical here, into a second switching position S2, which is inclined in the pull-out direction A. The pivot axis B is preferably designed as a section of the rack 10. The pivot axis B is thereby preferably formed as a section of the rack 10.

Both variants of guide adapters 6, 6' have in common that they each have a first housing part 61, 61' and a second housing part 64, 64', which can be fixed to each other by means of fastening elements 67, 67', in these exemplary embodiments in the form of screw bolts.

A section of a side wall of the rack 10 is clamped between the first housing part 61,61' and the second housing part 64, 64'.

Furthermore, respective ends of the unlocking device 8 are also accommodated between the housing parts 61, 61', 64, 64'.

Guide channels 62, 63, 62', 63' are integrally formed on an outer side of the first housing part 61, 61' facing away from the second housing part 64, 64'. In each of these guide channels 62, 63, 62', 63', a guide element 52 fixed to the second pivot arm 5 can be guided in such a way that, in the lowered position of the rack 10, when the rack 10 is pulled out into the lower pivoting position, the guide element 52 is guided along the rectilinear guide channel 62, 62' and, during the pivoting movement of the pivot arms 4, 5, is guided along or in the second guide channel 63, 63', which is formed in the shape of a segment of a circle.

As further shown in FIGS. 3 and 12, in the region of the end of the unlocking device 8 accommodated in the guide adapter 6, 6', a retaining web extends vertically downward, to which an unlocking element 83 is integrally formed or attached.

The unlocking element 83 is preferably designed as a wedge arranged on the transmission lever 82, with which the locking pin 53 can be pressed out of a locking groove 71 of the locking plate 7 along an inclined edge of the wedge.

Furthermore, in the embodiment variant shown in FIG. 3, the transmission lever 82 extends away from the actuating element 81 to a vertically downwardly extending arm 86, on which the support element 85 is formed in this embodiment variant.

Furthermore, the unlocking device 8 is held in the basic position under spring load. For this purpose, as shown in FIGS. 3 and 12, a spring element 84 held on the transmission lever 82 is held on the guide adapter 6, 6'.

The spring force of this spring element 84, which is designed here as a helical tension spring, counteracts a movement of the transmission lever 82 out of the basic position (first switching position S1).

Figure 2:
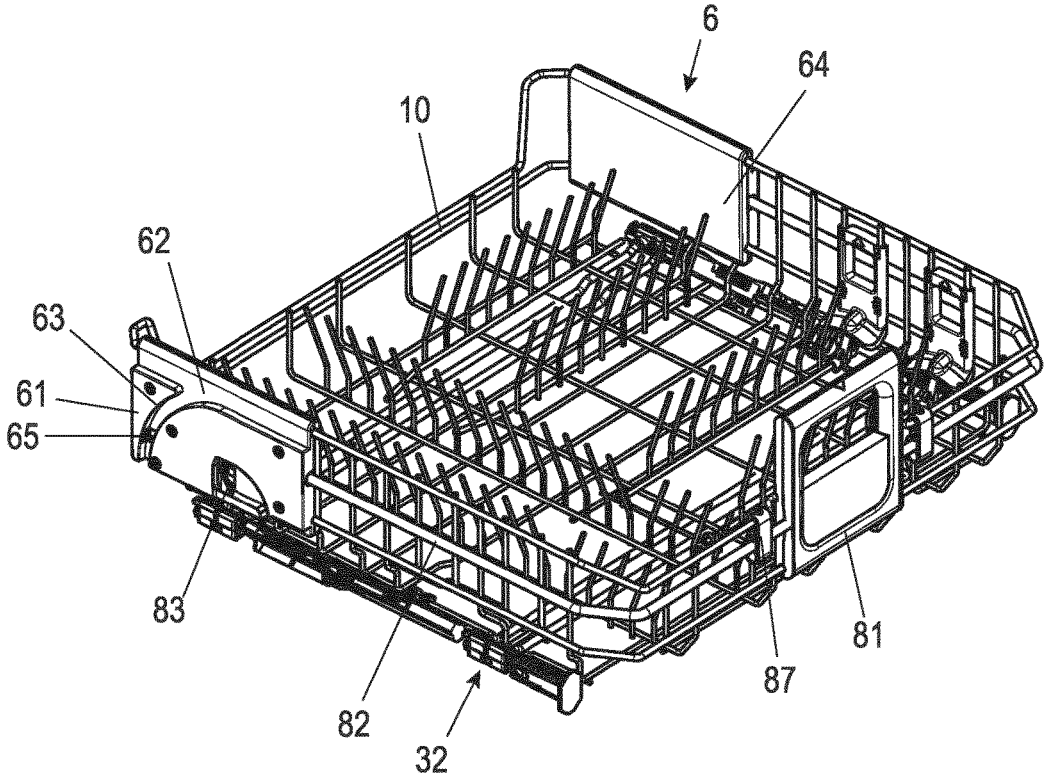
Figure 5:
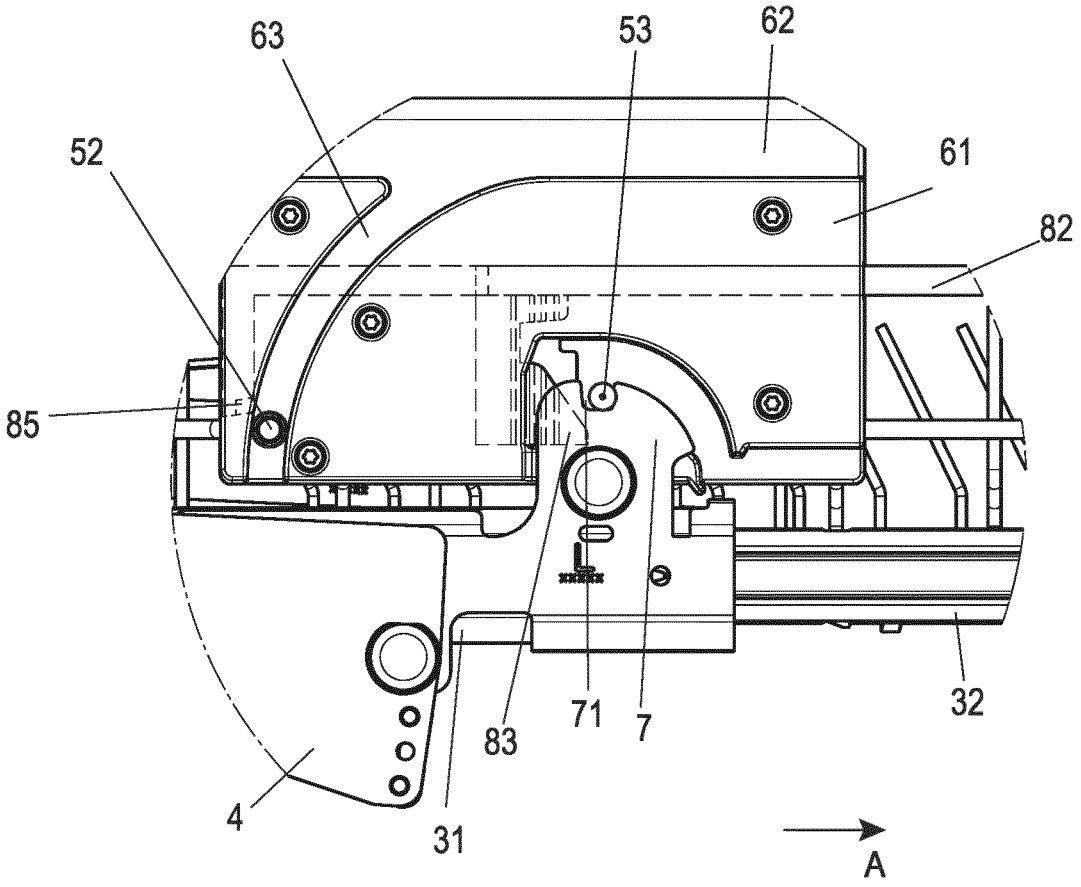

FIGS. 4 and 5 show the arrangement shown in FIGS. 2 and 3 in a blocking position of the locking pin 53 in the upper loading and unloading position of the rack 10.

As can be seen in particular in FIG. 5, the locking pin 53 here engages in the locking groove 71 of the locking plate 7.

In this position, the unlocking element 83 is not yet in contact with the locking pin 53 due to the positioning of the actuating element 81 in its vertical basic position (first switching position S1), but is positioned behind the locking pin 53 as viewed in the pull-out direction A.

As can further be seen in FIG. 5, the support element 85 at the rear end of the transmission lever 82 is also still positioned behind the guide element 52.

If the rack 10 is now to be pivoted from its upper loading and unloading position back to a lower position, the actuating element 81 is pivoted in pull-out direction A for this purpose.

In this case, the part of the transmission lever 82 guided along the side surfaces of the rack 10 is displaced by a first switching dimension in the pull-out direction A. This position is shown in FIGS. 6 and 7.

Figure 6:
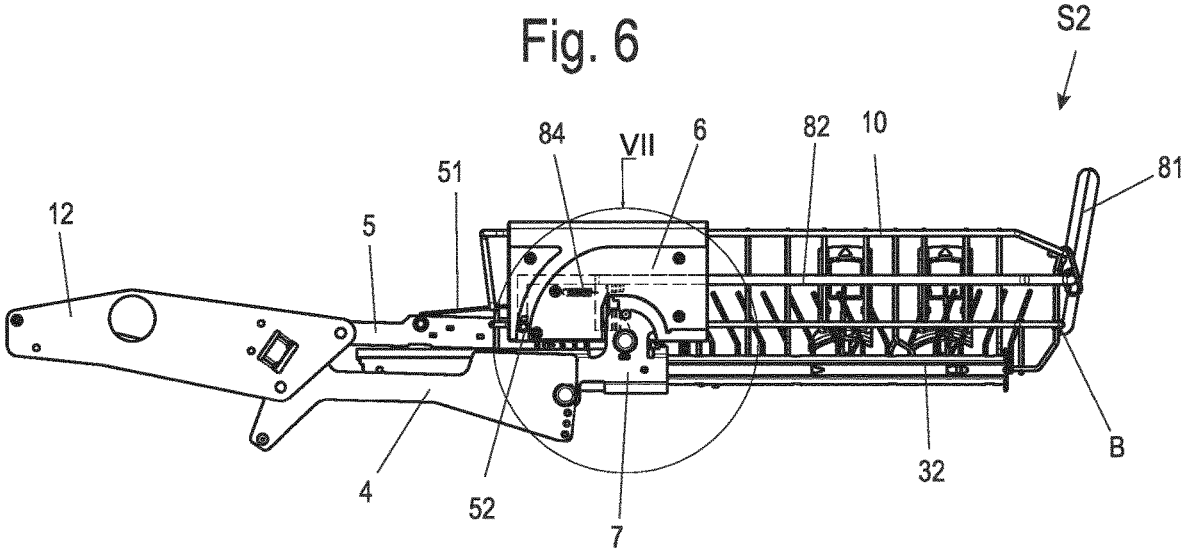
Figure 7:
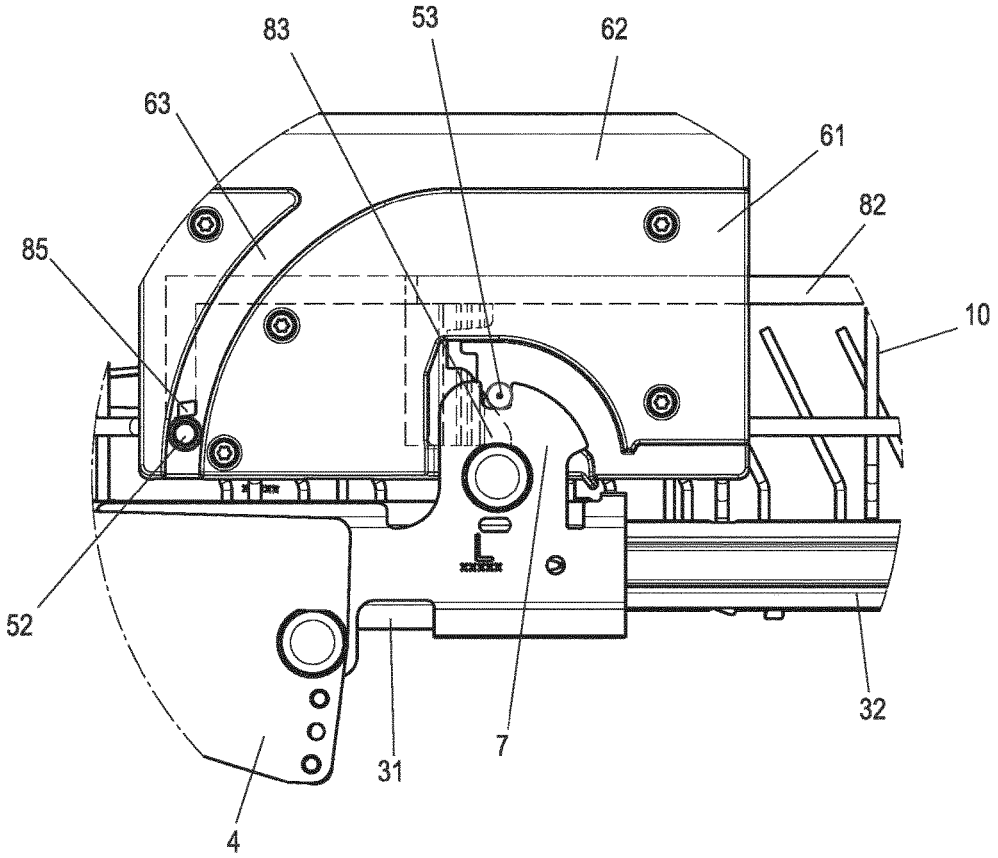

As can be seen clearly in FIG. 6, the actuating element 81 designed as a handle is pivoted by a first angle into the second switching position S2. Due to the accompanying slight displacement of the transmission lever 82 in the pull-out direction, the support element 85 of the unlocking device 8 pushes up onto the guide element 52 and thus at the same time slightly raises the rack 10 in order to facilitate the imminent pushing out of the locking pin 53 from the locking groove 71 in the locking plate 7.

Figure 9:
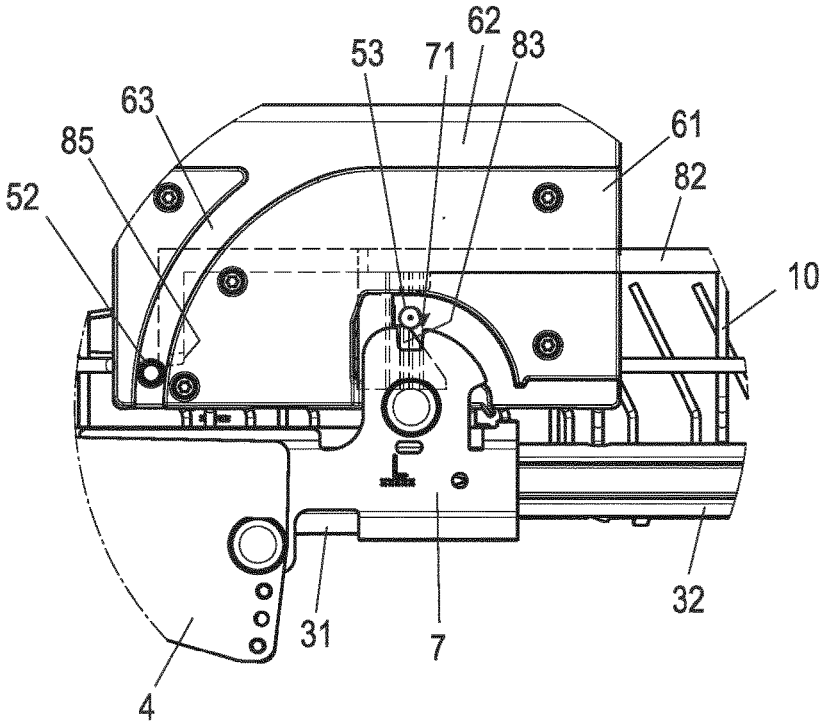
Figure 10:
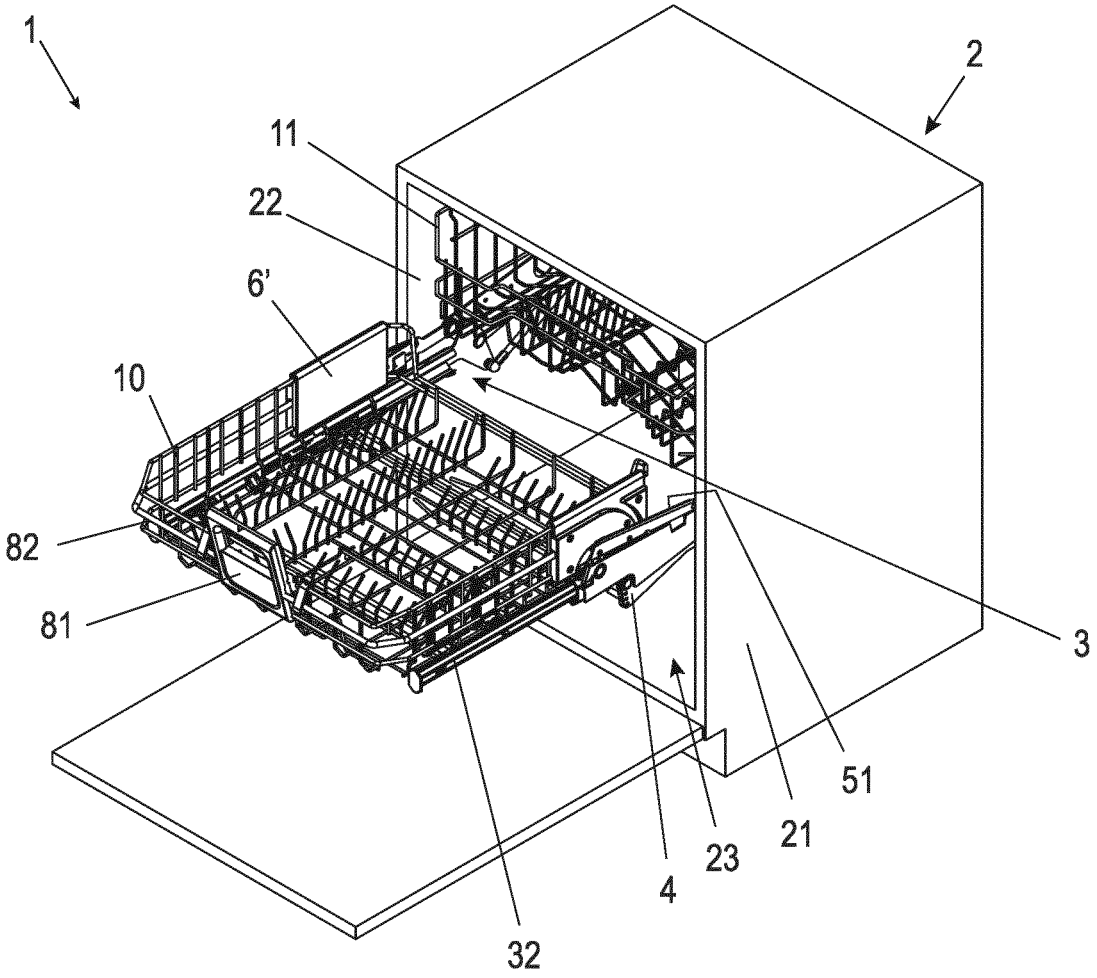
FIGS. 10 to 20 show a second embodiment variant of a sliding-pivoting mechanism according to the invention.
Figure 11:
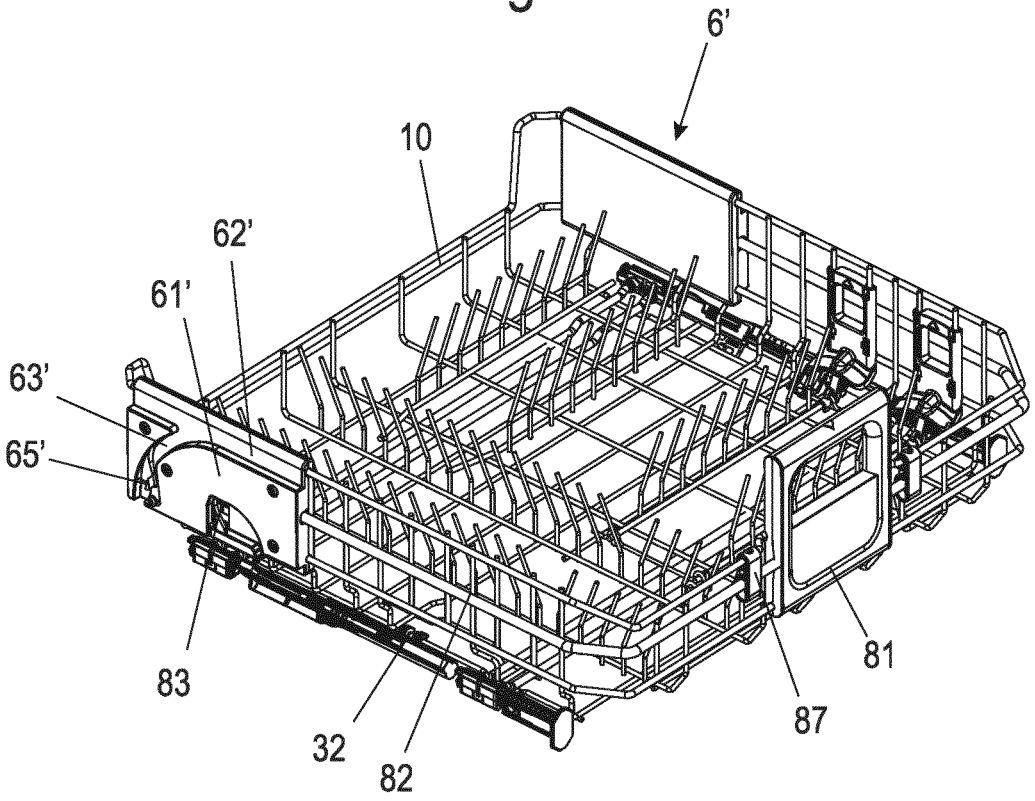

The pushing out of the locking pin 53 is achieved by pushing forward the unlocking element 83, as shown in FIGS. 8 and 9. Advancing the unlocking element 83 to the position shown in FIGS. 8 and 9 is achieved by further pivoting the actuating element 81 to a further inclined switching position S3.

In this case, the transmission lever 82 is again moved a little further in the pull-out direction A, so that the locking pin 53 is moved upwards out of the locking groove 71 along the slope of the unlocking element 83, which is designed here as a wedge.

At the same time, the further advancement of the transmission lever 82 causes the support element 85 to also be displaced further in the pull-out direction A, thereby clearing the guide channel 63 for the guide element 52 again.

During the movement described with reference to FIGS. 4 to 9, the support element 85 can be guided by a guide groove 65 on the inner side of the first housing part 61 facing the second housing part 64.

In the second embodiment variant of the sliding-pivoting mechanism according to the invention shown in FIGS. 10 to 20, the transmission lever 82 ends with the unlocking element 83.

Figure 14:
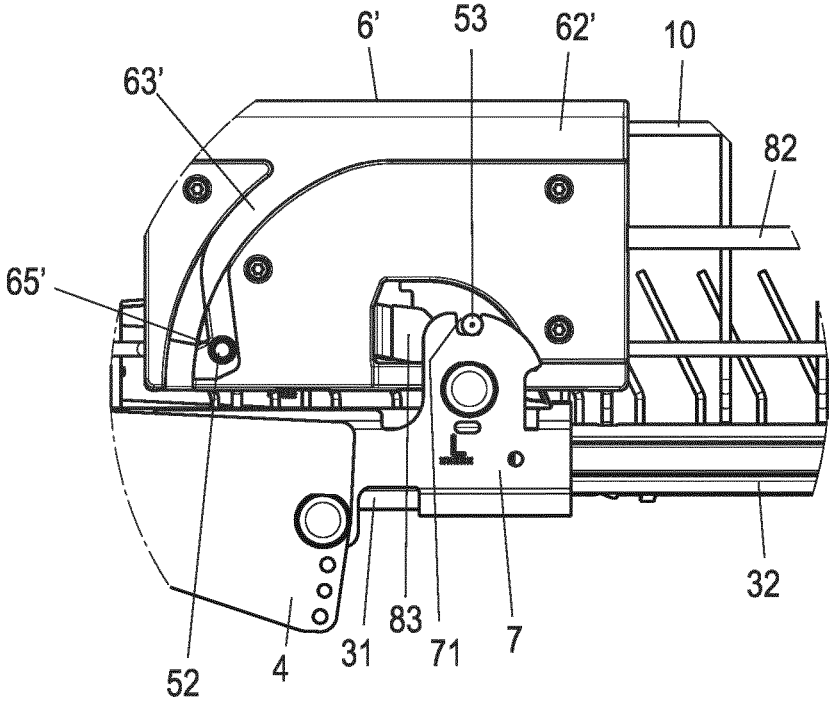
Figure 15:
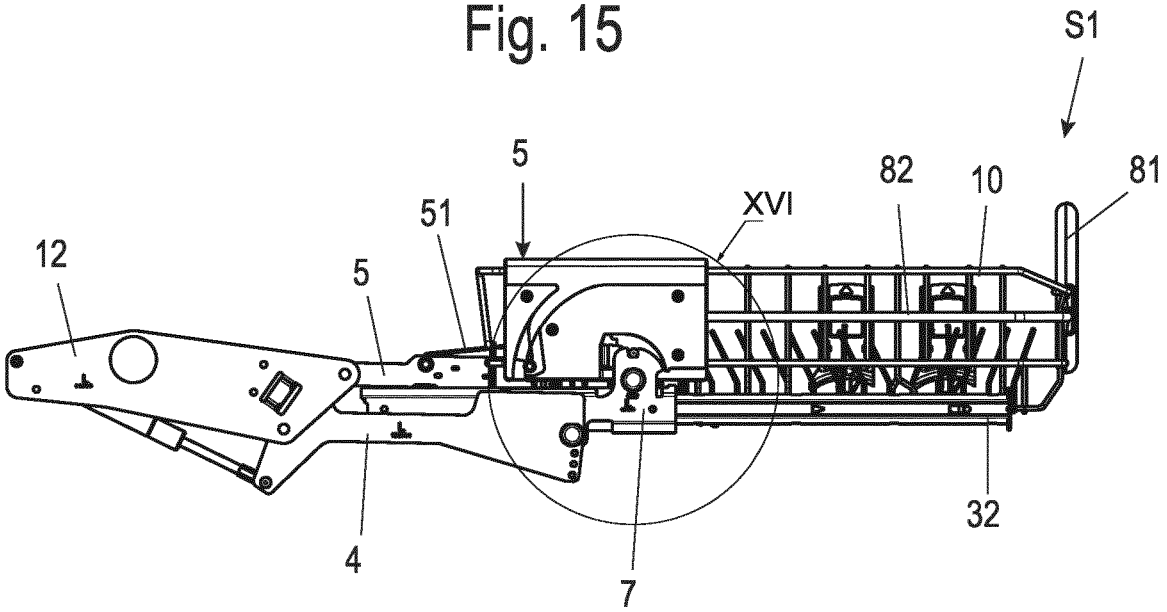
Figure 16:
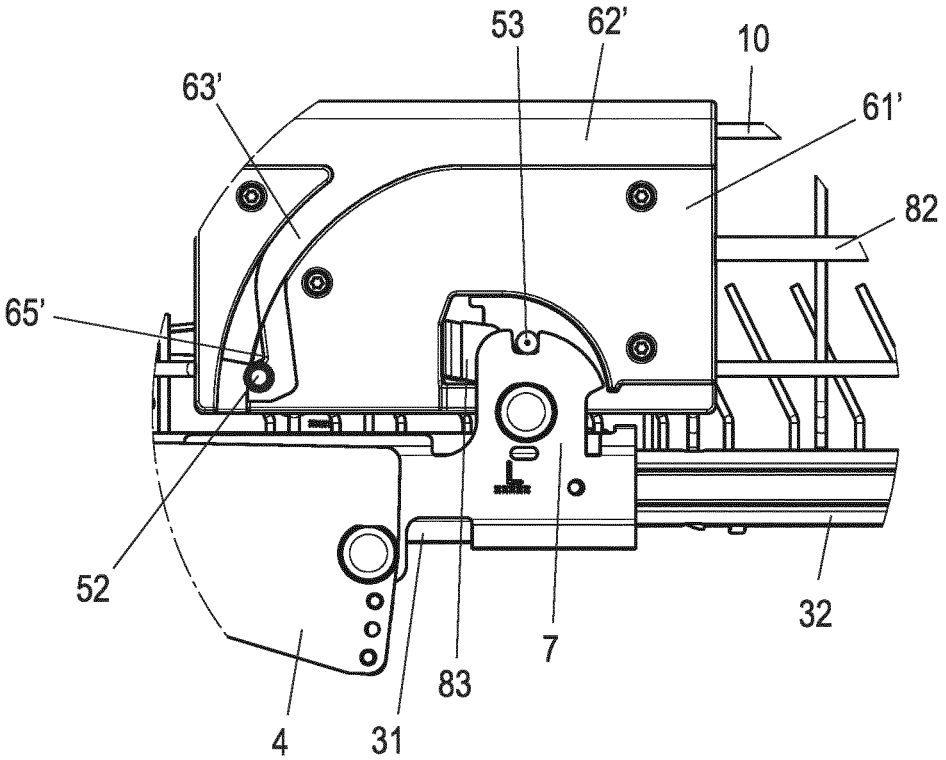

In this case, the support element 65' is formed as part of the guide adapter 6'. As shown in FIG. 12, the support element 65' is integrally formed here within the guide groove 63', and at a height such that the support element 65' can be pushed onto the guide element 52 when the rack 10 is moved from the upper loading and unloading position in the pull-out direction A, again raising the rack 10 slightly, as a comparison of FIGS. 14 and 16 shows.

FIGS. 13 and 14 again show the position of the rack in the upper loading and unloading position with the locking pin 53 locked in the locking groove 71.

Here, too, it is easy to see that the unlocking element 83 is positioned behind the locking pin 53 as viewed in the pull-out direction A.

Similarly, the support element 65' integrally formed in the second guide channel 63' is arranged behind the guide element 52 as viewed in the pull-out direction A.

To unlock the rack 10 from the upper loading and unloading position and pivot it downward in this variant, the rack 10 is first moved slightly in pull-out direction A.

In this case, the support element 65' is pushed onto the guide element 52, as can be seen clearly in FIG. 16, which is accompanied by a simultaneous slight lifting of the rack 10.

Subsequently, the actuating element 81 is also pivoted here from the first switching position S1, which is perpendicular here, to the second switching position S2, which is accompanied by a linear displacement of the transmission lever 82 relative to the rack 10 in the pull-out direction A.

In this case, the unlocking element 83 is displaced in the pull-out direction A and, along the slope of the wedge-shaped unlocking element 83, pushes the locking pin 53 up out of the locking groove 71 of the locking plate 7.

Since in this case the rack 10 has not been moved further in the pull-out direction, the support element 65' remains in its position supported on the guide element 52.

Figure 19:
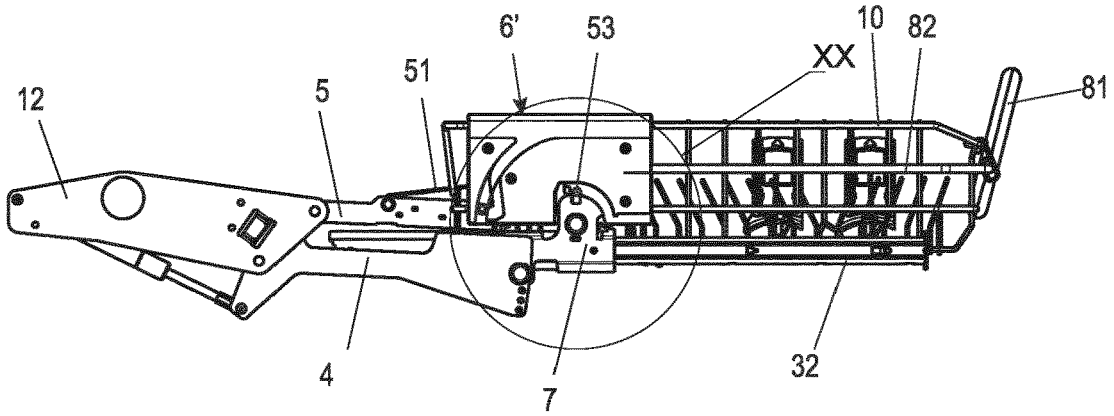
Figure 20:
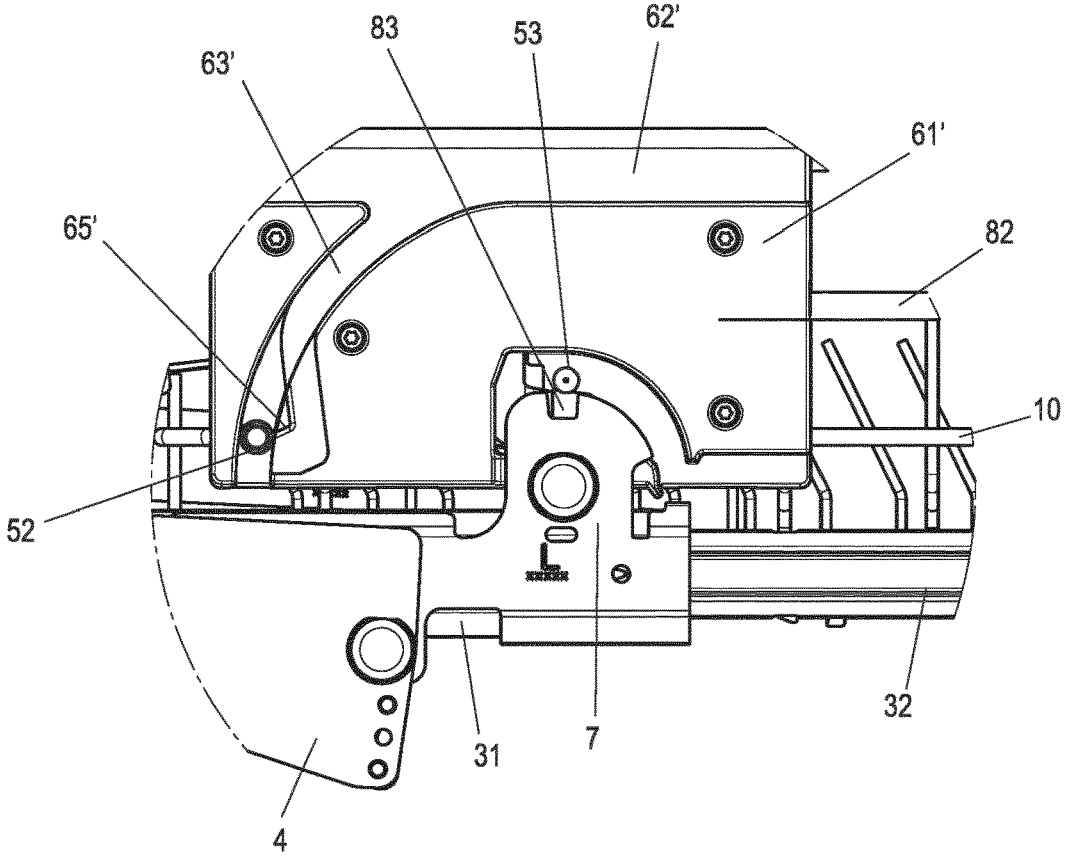

Only when the rack 10 is advanced further again in the pull-out direction A, as shown in FIGS. 19 and 20, will the guide adapter 6' be displaced in the pull-out direction A to such an extent that the guide element 52 enters a region of the second guide channel 63' in which movement of the guide element 52 along the guide channel 63 in the direction of the first guide channel 62' is possible.

As can be seen in FIGS. 2, 8, 11 and 19, in order to limit the pivoting movement of the actuating element 81, the transmission lever 82 is held parallel to the pivot axis B of the actuating element 81 by at least one clip 87 attached to a web of the rack 10.

In the embodiment variants shown here, one such clip 87 is arranged on each side of the actuating element 81.

Although the invention has been illustrated and described in detail by way of preferred embodiments, the invention is not limited by the examples disclosed, and other variations can be derived from these by the person skilled in the art without leaving the scope of the invention. It is therefore clear that there is a plurality of possible variations. It is also clear that embodiments stated by way of example are only really examples that are not to be seen as limiting the scope, application possibilities or configuration of the invention in any way. In fact, the preceding description and the description of the figures enable the person skilled in the art to implement the exemplary embodiments in concrete manner, wherein, with the knowledge of the disclosed inventive concept, the person skilled in the art is able to undertake various changes, for example, with regard to the functioning or arrangement of individual elements stated in an exemplary embodiment without leaving the scope of the invention, which is defined by the claims and their legal equivalents, such as further explanations in the description.

LIST OF REFERENCE SIGNS

1 Dishwasher
2 Carcass
21 Side wall
22 Side wall
23 Interior
3 Pull-out guide
31 Guide rail
32 Running rail
4 Pivot arm
5 Pivot arm
51 Web
52 Guide element
53 Locking pin
6 Guide adapter
61 First housing part
62 Guide channel
63 Guide channel
64 Second housing part
65 Guide groove
66 Receiving groove
67 Fastening element
6' Guide adapter
61' First housing part
62' Guide channel
63' Guide channel
64' Second housing part
65' Support element
66' Receiving groove
67' Fastening element
7 Locking plate
71 Locking groove
8 Unlocking device
81 Actuating element
82 Transmission lever

83 Unlocking element
84 Spring element
85 Support element
86 Arm
87 Clip
10 Rack
11 Rack
12 Side wall mounting
S1 First switch position
S2 Second switch position
S3 Third switch position
A Pull-out direction
B Pivot axis

The invention claimed is:

1. A sliding-pivoting mechanism for a rack of a piece of furniture or domestic appliance for pulling out and lifting the rack from a carcass of the piece of furniture or domestic appliance, the sliding-pivoting mechanism comprising at least two pivot arms configured for pivotable fixing to the carcass are arranged parallel to one another and form a parallel guide for a pull-out guide, wherein the pull-out guide comprises at least one guide rail and a running rail displaceable relative to the guide rail and to which the rack is fastened;

a locking mechanism arranged on the guide rail and on one of the at least two pivot arms to prevent simultaneous pivoting and sliding movement of the rack, wherein the locking mechanism comprises a locking pin movably arranged on one of the at least two pivot arms and a locking plate mounted in a positionally fixed manner with respect to the guide rail, wherein the locking plate and the locking pin interact in such a way that a pivoting movement of the at least two pivot arms is blocked when the rack is lifted into an upper loading and unloading position;

an unlocking device coupled to the locking mechanism and having an actuating element and an unlocking element with which the locking pin is moveable from a blocking position into a release position; and a support device having a guide element arranged on one of the at least two pivot arms and a support element arranged on the rack, wherein the support elements are moveable relative to the guide element and supportable in a support position on the guide element, wherein the actuating element is a handle, which is tiltable about a horizontal pivot axis and is coupled to the unlocking element via a transmission lever, and wherein the unlocking element is a wedge arranged on the transmission lever, with which the locking pin can be pressed out of a locking groove of the locking plate along an oblique edge of the wedge.

2. The sliding-pivoting mechanism of claim 1, wherein the guide element is fixed to the second pivot lever and, when a pivoting movement is performed, the second pivot lever is guided along a guide groove of a guide adapter fixed to the rack.

3. The sliding-pivoting mechanism of claim 2, wherein the support element is part of the unlocking device.

4. The sliding-pivoting mechanism of claim 3, wherein the support element is integrally formed on an arm oriented at an angle to the transmission lever, wherein the support element projects into a guide groove of the guide adapter when the actuating element is moved from a first switching position into a second switching position of the actuating element in such a way that the support element is pushable onto the guide element.

5. The sliding-pivoting mechanism of claim 2, wherein the support element is a section of the guide adapter.

6. The sliding-pivoting mechanism of claim 5, wherein the support element is integrally formed within the guide groove, wherein the support element can be pushed onto the guide element when the rack is moved from the upper loading and unloading position in a pull-out direction.

7. The sliding-pivoting mechanism of claim 6, wherein the support element is disengaged from the guide element by a combination of moving the rack from the upper loading and unloading position in the pull-out direction and pivoting the actuating element from a first switching position in the pull-out direction to a second switching position, and the locking mechanism is unlocked.

8. The sliding-pivoting mechanism of claim 7, wherein the unlocking device is held spring-loaded in the first switching position.

9. The sliding-pivoting mechanism of claim 8, wherein a spring element held on the transmission lever is held on the guide adapter, wherein a spring force of the spring element counteracts a movement of the transmission lever out of the first switching position.

10. The sliding-pivoting mechanism of claim 1, wherein, in order to limit a tilting movement of the actuating element, the transmission lever, which is aligned parallel to the horizontal pivot axis of the actuating element, is held by at least one clip fastened to a web of the rack.

11. A piece of furniture or domestic appliance, comprising:

a carcass; and at least one rack guided in the carcass via a sliding-pivoting mechanism, wherein the sliding-pivoting mechanism comprises at least two pivot arms configured for pivotable fixing to the carcass are arranged parallel to one another and form a parallel guide for a pull-out guide, wherein the pull-out guide comprises at least one guide rail and a running rail displaceable relative to the guide rail and to which the rack is fastened;

a locking mechanism arranged on the guide rail and on one of the at least two pivot arms to prevent simultaneous pivoting and sliding movement of the rack, wherein the locking mechanism comprises a locking pin movably arranged on one of the at least two pivot arms and a locking plate mounted in a positionally fixed manner with respect to the guide rail, wherein the locking plate and the locking pin interact in such a way that a pivoting movement of the at least two pivot arms is blocked when the rack is lifted into an upper loading and unloading position;

an unlocking device coupled to the locking mechanism and having an actuating element and an unlocking element with which the locking pin is moveable from a blocking position into a release position; and a support device having a guide element arranged on one of the at least two pivot arms and a support element arranged on the rack, wherein the support elements are moveable relative to the guide element and supportable in a support position on the guide element, wherein the actuating element is a handle, which is tiltable about a horizontal pivot axis and is coupled to the unlocking element via a transmission lever, and wherein the unlocking element is a wedge arranged on the transmission lever, with which the locking pin can be pressed out of a locking groove of the locking plate along an oblique edge of the wedge.

12. A dishwasher comprising:

a carcass; and at least one dish rack guided in the carcass via a sliding-pivoting mechanism, wherein the sliding-pivoting mechanism comprises at least two pivot arms configured for pivotable fixing to the carcass are arranged parallel to one another and form a parallel guide for a pull-out guide, wherein the pull-out guide comprises at least one guide rail and a running rail displaceable relative to the guide rail and to which the dish rack is fastened;

a locking mechanism arranged on the guide rail and on one of the at least two pivot arms to prevent simultaneous pivoting and sliding movement of the dish rack, wherein the locking mechanism comprises a locking pin movably arranged on one of the at least two pivot arms and a locking plate mounted in a positionally fixed manner with respect to the guide rail, wherein the locking plate and the locking pin interact in such a way that a pivoting movement of the at least two pivot arms is blocked when the dish rack is lifted into an upper loading and unloading position;

an unlocking device coupled to the locking mechanism and having an actuating element and an unlocking element with which the locking pin is moveable from a blocking position into a release position; and a support device having a guide element arranged on one of the at least two pivot arms and a support element arranged on the dish rack, wherein the support elements are moveable relative to the guide element and supportable in a support position on the guide element, wherein the actuating element is a handle, which is tiltable about a horizontal pivot axis and is coupled to the unlocking element via a transmission lever, and wherein the unlocking element is a wedge arranged on the transmission lever, with which the locking pin can be pressed out of a locking groove of the locking plate along an oblique edge of the wedge.

* * * * *